US005285574A

United States Patent [19]

Feltner

[11] Patent Number: 5,285,574

[45] Date of Patent: Feb. 15, 1994

[54] CARTON OPENER

[75] Inventor: Dennis P. Feltner, West Chester, Ohio

[73] Assignee: Cosco Industries, Inc., Spring Valley, N.Y.

[21] Appl. No.: 972,931

[22] Filed: Nov. 6, 1992

[51] Int. Cl.[5] ..... B67B 7/00; B26B 3/06

[52] U.S. Cl. ..... 30/2; 30/162

[58] Field of Search ..... 30/2, 125, 160, 161, 30/162, 286, 325, 125, 162; 83/946, 5.44; 53/381.1, 381.2

[56] References Cited

U.S. PATENT DOCUMENTS

| | | | |
|---|---|---|---|
| 2,840,903 | 7/1958 | Christensen | 30/162 |
| 3,092,903 | 6/1963 | Bockhold | 30/2 |
| 3,406,447 | 10/1968 | Travlos | 30/2 |
| 3,621,570 | 11/1971 | Kolde et al. | 30/162 |
| 3,879,847 | 4/1975 | Roll | 30/162 |
| 4,005,525 | 2/1977 | Gringer | 30/125 |
| 4,089,112 | 5/1978 | Richards | 30/162 |
| 4,139,939 | 2/1979 | Crooks | 30/2 |
| 4,442,595 | 4/1984 | Sharrow et al. | 30/2 |
| 4,531,286 | 7/1985 | Vito et al. | 30/2 |
| 4,570,342 | 2/1986 | Baum | 30/162 |
| 4,586,256 | 5/1986 | Weimann | 30/162 |
| 4,675,996 | 6/1987 | DuBuque | 30/2 |
| 4,744,146 | 5/1988 | Schmidt | 30/125 |
| 4,761,882 | 8/1988 | Silverstein | 30/125 |
| 4,813,132 | 3/1989 | Castelluzzo | 30/162 |
| 4,884,307 | 12/1989 | Flood | 7/156 |
| 4,980,977 | 1/1991 | Matin et al. | 30/286 |
| 5,054,198 | 10/1991 | Gmoch | 30/2 |
| 5,093,994 | 3/1992 | Karas | 30/162 |

OTHER PUBLICATIONS

Exhibits 1 and 2: photos of carton opener/utility knife manufactured by SDI of Taipei, Taiwan, Circa. 1977.

*Primary Examiner*—Richard K. Seidel
*Assistant Examiner*—Paul M. Heyrana, Sr.
*Attorney, Agent, or Firm*—Senniger, Powers, Leavitt & Roedel

[57] ABSTRACT

A carton opener has a blade holder for receiving and holding a single edged razor blade. A sheath has a body portion including two side walls closely fitted about the blade holder in which the blade holder is capable of sliding within the sheath between a blade retracted position to at least one blade extended position. A slot is formed on one of the side walls longitudinally along the length of the sheath. A moving member is attached to the blade holder and extends from the blade holder through the slot and is in registry with the slot for moving the blade holder longitudinally with respect to the sheath. The moving member includes a detent biased to a side of the slot having recesses for releasably engaging the recesses when the detent is adjacent thereto.

3 Claims, 3 Drawing Sheets

CARTON OPENER

BRIEF SUMMARY OF THE INVENTION

This invention relates generally to a utility knife and more particularly to a carton opener having a blade movable into and out of a protective sheath.

Presently, there are many carton openers capable of storing a cutting blade in a sheath in a concealed position and which permit movement of the blade to at least one extended position where it can be used for cutting. However, many of these openers are complicated in construction and manufacture, are incapable of positively retaining the blade in an extended or retracted position and/or must be disassembled in order to change the cutting blade.

Among the several objects of this invention may be noted the provision of an improved carton opener in which a removable blade of the carton opener is supported by a holder within a sheath and is so constructed and arranged as to allow the holder to be moved to and locked in a blade retracted position, in at least one blade cutting position and in a blade changing position in which the blade may be replaced without disassembling the carton opener; the provision of such a carton opener which may be completely disassembled for its repair, cleaning and replacement of any broken parts: the provision of such a carton opener in which its various components (i.e., the blade, a blade holder and a sheath) may be easily assembled without the aid of tools; and the provision of such a carton opener which is easy to use, durable, and economical to manufacture.

Generally, a carton opener constructed according to the principles of the present invention comprises a blade holder of the type adapted to receive and hold a single edged razor blade; a sheath having a body portion including two side walls closely fitted about the razor blade holder and in which the razor blade holder is adapted to slide between a blade retracted position in which the body portion of the sheath covers the blade to at least one blade cutting position in which the blade held by the holder is positioned for cutting, and to a blade extended position in which the blade holder extends out forward of the body portion sufficiently to allow the blade to be removed and a new one inserted in the blade holder. Preferably, a slot is formed in one of the side walls longitudinally along the length of the sheath and a moving member attached to the blade holder extends from the blade holder through the slot in registry with the slot for moving the blade holder longitudinally with respect to the sheath. In its preferred form, the slot has a plurality of recesses formed in one side and the moving member comprises a detent biased to the side of the slot having the recesses, for releasably engaging the recesses when the detent is adjacent thereto. The recesses receive the detent for positioning the blade holder relative to the sheath.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
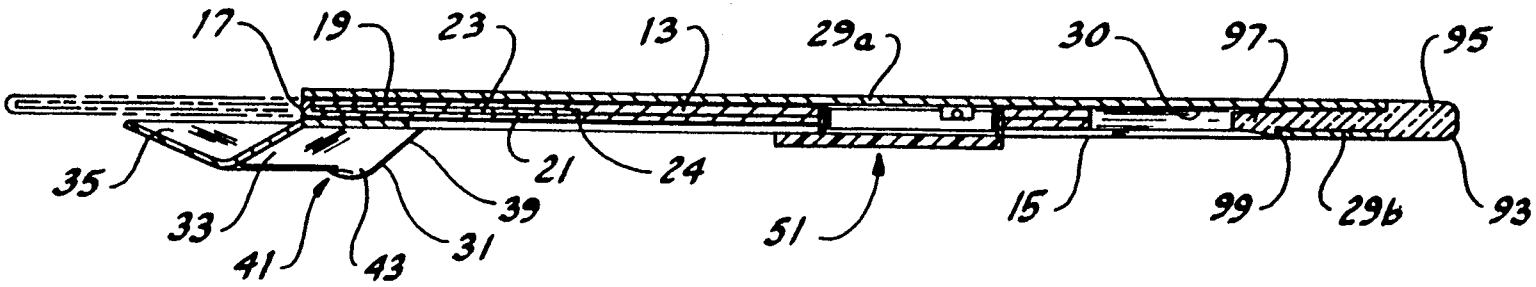
FIG. 2 is a cross-sectional view taken along line 2—2 in FIG. 1.
Figure 3:
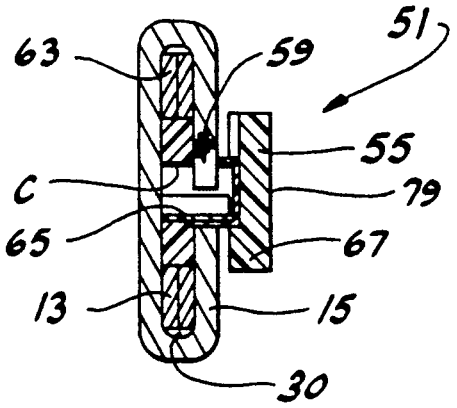
FIG. 3 is a cross-sectional view taken along line 3—3 in FIG. 1.
Figure 5:
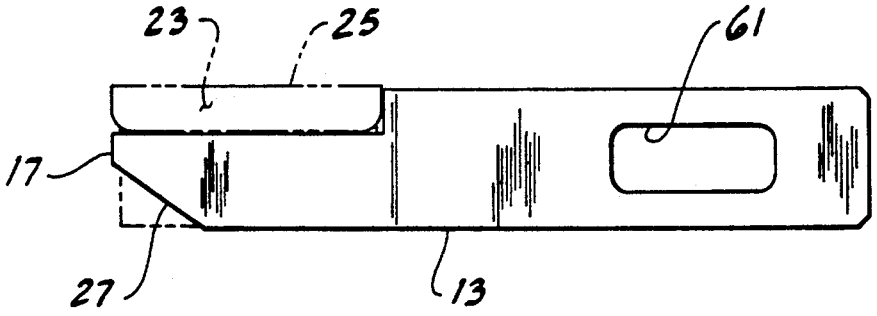
FIG. 5 is a plan view of a single edge razor blade holder of the carton opener.

Referring now to the drawings, there is generally indicated at 11 a carton opener of the present invention capable of cutting an edge of a carton or cardboard box. The carton opener is of the type comprising a single edge razor blade holder 13 and a sheath 15. As best seen in FIGS. 2 and 5, the holder 13 comprises a strip of sheet metal folded on itself at 17 providing first and second layers 19 and 21, respectively. The forward end portion of the holder 13 extends back from the fold 17 for a distance slightly longer than the length of a single edge blade 23 and defining a passageway 24 therebetween in which may be inserted a blade 23 having a back edge 25. The blade illustrated is of a conventional type of construction with the blade being relatively stiff and having an inverted U-shaped channel strip defining the back edge 25 secured over its top edge. The holder 13 has a thickness substantially equal to the thickness of the back edge 25 so that when the blade 23 is inserted between the first and second layers 19, 21, the back 25 will not protrude beyond the sides of layers 19, 21 within the passageway 24. One corner of both layers 19, 21 at the folded end of the strip is removed as indicated at 27 to expose one corner of the blade 23.

The sheath 15 is of a generally flattened tubular form and has a body portion 29 and a guide member 31. The length of the body portion 29 is longer than the length of the holder 13. Body portion 29 includes opposing side walls *29a*, *29b*, which define a passageway 30 therein so that the sheath closely fits about the holder 13. The holder is capable of sliding within the passageway 30 of the sheath between a retracted position in which the blade holder is completely disposed within the passageway and a number of extended position in which the forward portion of the holder 13 and the lower corner of the blade 23 is exposed for use. The blade holder retracted position is achieved by sliding the holder 13 rearwardly in the sheath 15 in which the entire blade is covered by body portion 29.

As shown in the drawings, guide member 31 extends forward of body portion 29. The guide member 31 comprises first and second generally planar panels 33, 35, the first panel 33 extends forward from the body portion 29 at an obtuse lateral angle relative to the general plane of the body portion 29 as shown in FIG. 2, and the second panel 35 extends forward from the first panel 33. The plane of first panel 33 is generally perpendicular to the plane of second panel 35. Additionally, the guide member 31 has forward edges 37 and rearward edges 39. The guide member 31 is configured for guiding the corner of the blade 23 along an edge of a carton in a rearward direction of movement. Rearward edges 39 first engage the carton as the carton opener cuts the edge of the box.

The guide member 31 has a flared margin, generally indicated at 41, which facilitates the movement of the carton opener along the edge of a cardboard box. The flared margin 41 extends from rearward edges 39 of guide member 31 at an angle to the first and second panels 33, 35. The flared margin 41 is adapted to prevent the snagging or catching of the rearward edges 39 against the carton when the opener is cutting the edge of the carton. Because of deformities along the edge of the carton, flared margin 41 is generally rounded as at 43 to prevent snagging or catching of the guide member 31 while cutting the carton.

In its preferred embodiment, the guide member 31, body portion 29 and flared margin 41 are integrally formed. The first panel 33 extends from the body portion 29 at a first bend line 45 and the second panel 35 extends from the first panel 33 at a second bend line 47. The first bend line 45 forms a generally oblique angle with the longitudinal axis of the body portion (see FIG. 1). As mentioned earlier, first panel 33 is generally perpendicular to second panel 35, thus forming the configuration necessary for guiding the carton opener along the edge of a carton (see FIG. 4). The flared margin 41 extends from the guide member at a third bend line 49 which is generally perpendicular to the first and second bend lines 45, 47. Flared margin 41 may extend at an angle generally oblique to the first and second panels 33, 35. However, the flared margin 41 is limited only to the extent that it performs the desired function of avoiding snagging on a box edge. Flared margin 41 need not extend a great length away from guide member 31, but may be a rounded or radius edge, as long as it performs the desired function.

Means for moving and for temporarily locking the blade holder 13 between its retracted position and extended positions is indicated generally at 51. Means 51 comprises a slot 53 formed in one of the side walls (e.g., side wall **29*b*) longitudinally along the length of the sheath 15. A moving member 55, which is in registry with the slot 51 for moving the blade holder 13 longitudinally with respect to the sheath 15, extends from the blade holder through the slot. A plurality of recesses 57 are formed in one edge of the slot 53 for receiving a detent, generally indicated at 59, extending laterally from the moving member to the side of the slot having the recesses. The detent 59 is spring biased for releasably engaging the recesses 57 when the detent is adjacent thereto and to stay within a recess until a sufficient force is exerted on the moving member 55 to move it against the bias of the detent such that the detent engages the edge of the slot. The recesses 57 receive the detent 59 for positioning and temporarily locking the blade holder 13 relative to the sheath 15, thereby providing a number of positions for holding the blade holder. As shown there are four such recesses which provide four positions, three recesses (recesses 57*a*, 57*b* and 57*c*) providing three blade holder extended positions and one recess (recess 57*d***) providing one blade holder retracted position.

Figure 1:
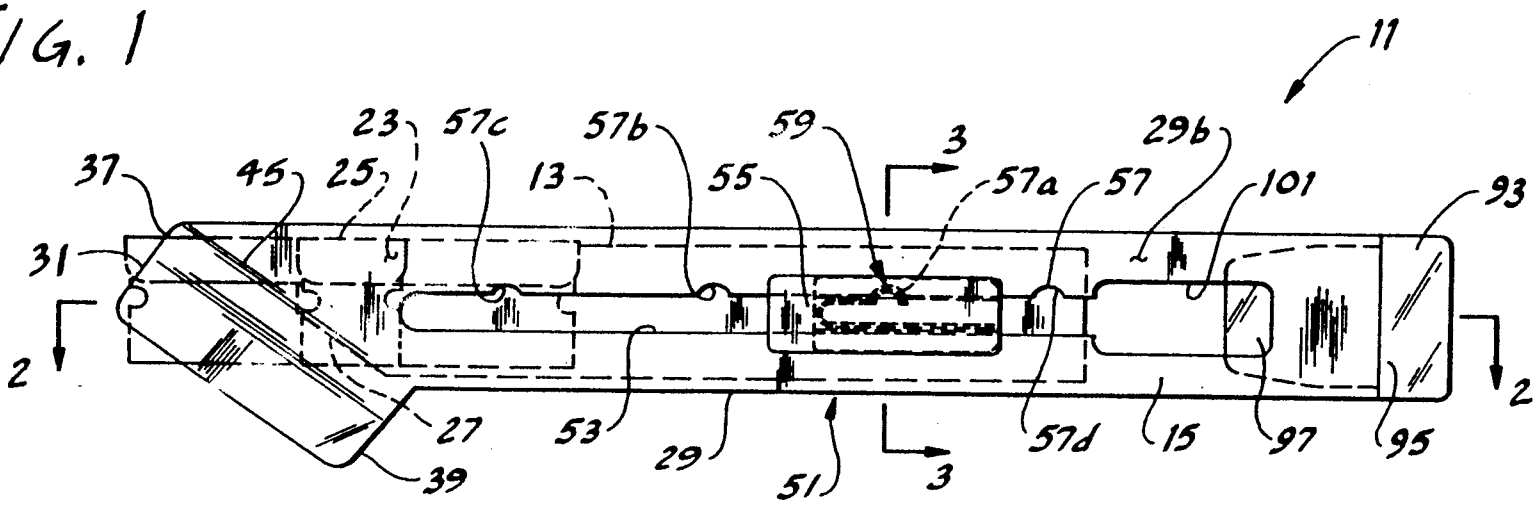
FIG. 1 is a plan view of a carton opener of the present invention.
Figure 4:
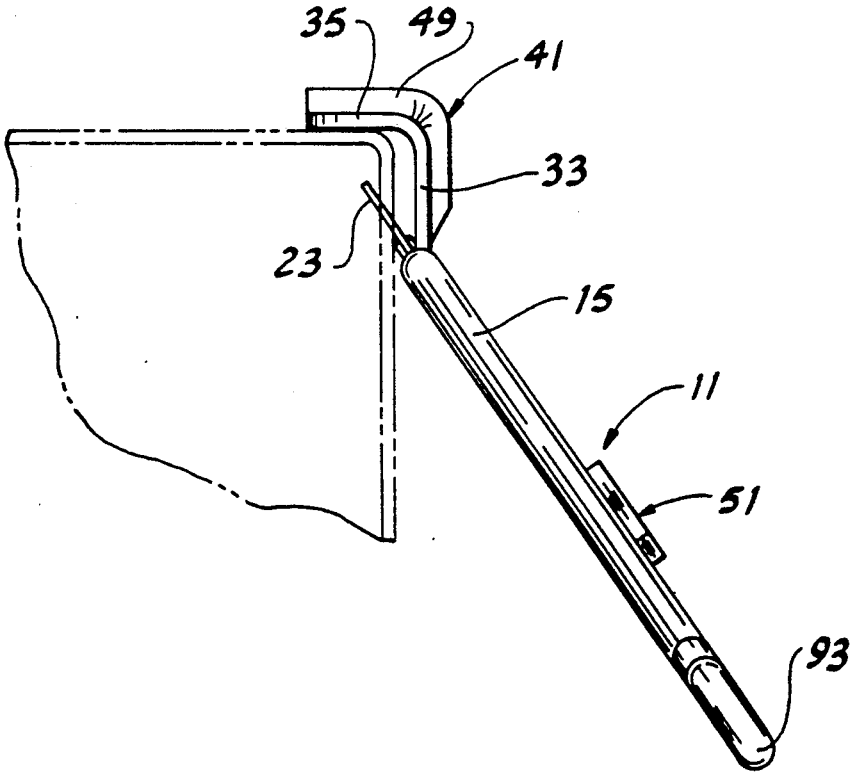
FIG. 4 is a view of the carton opener engaging a carton along the edge of the carton.

Turning now to FIGS. 1, 2 and 4, the blade holder 13 is shown to be in a first cutting position in which the blade holder is positioned to cut an edge of a carton (see FIG. 4). In this position, the detent 59 engages the first recess **57*a*. The second cutting position (shown in phantom in FIG. 1) is provided for using the carton opener as a razor without interference from guide member 31. In this position, the guide member 31 controls the depth of the cut since the corner of the blade extends just beyond the edge of the guide member. In the second cutting position, the detent 59 engages recess 57*b*. FIG. 2 shows the blade holder 13 (in phantom) in a blade extended position or its most forwardly extended position, in which the sheath 15 of the carton opener does not enclose the razor blade 23, thereby exposing the back edge 25 of the razor blade. In this position, the detent 59 engages recess 57*c*, and the blade 23 may easily be removed from the holder and a new blade may be inserted in the holder between layers 19 and 21 of the holder. In the blade holder retracted position (not shown), the detent 59 engages recess 57*d***.

Figure 7:
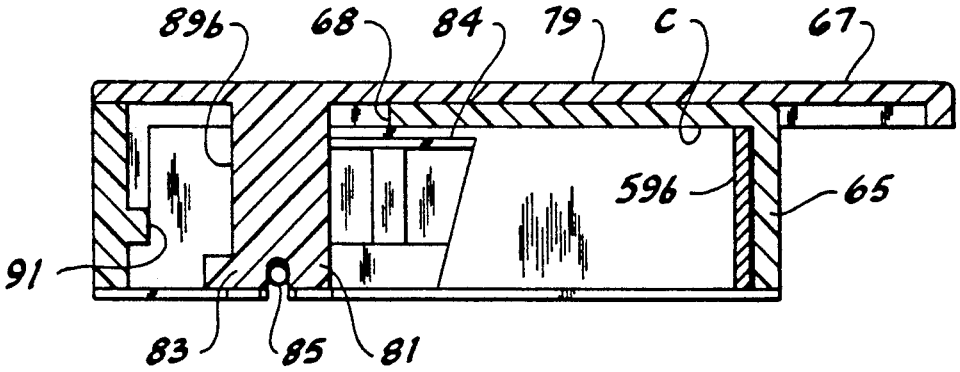
FIG. 7 is a cross-sectional view taken along line 7—7 in FIG. 6.
Figure 6:
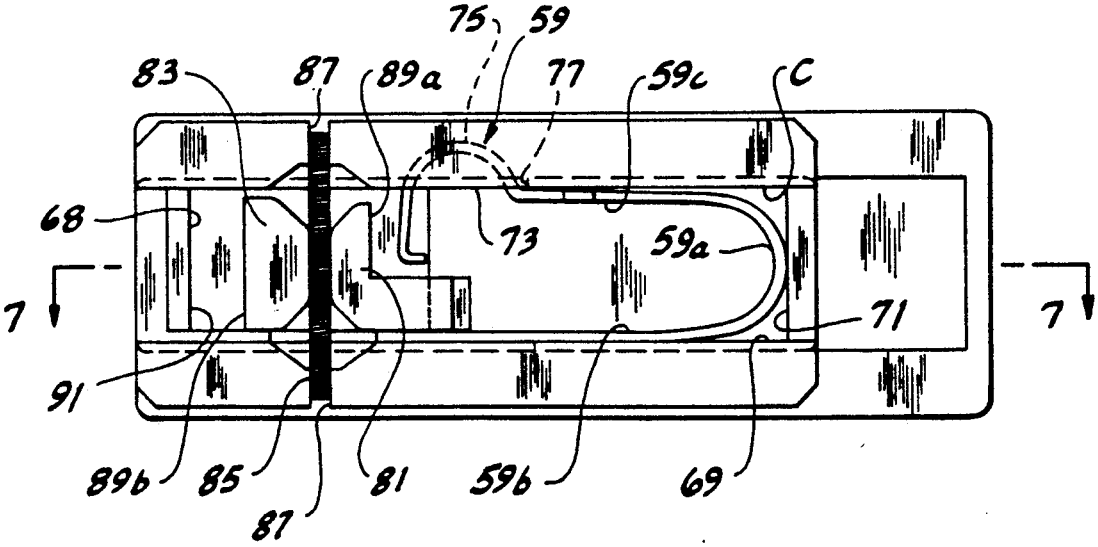
FIG. 6 is an enlarged bottom view of a moving member of the carton opener.

Referring now to FIGS. 5–7, the blade holder 13 is provided with a rectangular opening 61 which is in registry with slot 53. The moving member 55 is a separate piece from the blade holder 13 and comprises a base 63 which has a shape as viewed from above corresponding generally to the rectangular opening 61, a stem 65 extending upwardly from the base through slot 53, and a retaining cap 67 removably attached to the stem opposite of the base. The base 63 has a slightly lesser cross-sectional area than passageway 30 and is configured to slide with the blade holder within the passageway. The base 63 is further capable of being moved from a position in which it is seated within the opening 61 of the holder 13 such that it is captured within the passageway 30 along with the blade holder, to a position in which it is removed from the opening. The retaining cap 67 and the base 63 have a greater width than the width of the slot 53, and the stem 65 has a width less than the width of the slot so that the base of the moving member is captured by the sheath and capable of sliding with the blade holder between its retracted and extended positions. In its shown configuration, the base 63 and stem 65 are integrally attached to each other, while the retaining cap 67 is removably attached to the stem.

A rectangular cavity C accessible through an opening 68 is provided within the stem 65 in which detent 59 is retained. Detent 59 is formed from sheet metal and is generally U-shaped (the bottom of the U designated **59*a*, and the laterally opposite sides of the U designated 59*b* and 59*c*) in which the longer side of the U 59*b* abuts a long side wall 69 of the cavity C, the bottom of the U 59*a* abuts a short end wall 71 of the cavity and the shorter side of the U-shape 59*c* abuts the other long side wall 73 of the cavity. The detent is securely retained within the cavity without having to fasten the detent therein. Side 59*c* of the detent has an inverted C-shaped protrusion 75 which extends through an opening 77 formed in the side wall 73 of the stem 65. The protrusion (which defines the detent 59) has a shape generally corresponding to the shape of the recesses 57 and is adapted to move downwardly towards side wall 69 of the cavity C upon engaging the edge of the slot 53. The amount of force required to move the moving member 55 from a position in which the protrusion 75 of detent 59 is engaging a recess 57 to a position in which the detent engages the edge of the slot depends in part on the shape of the detent and the shape of the recess. As shown, the detent and recess are gently curved to have a C shape. This configuration allows a relatively nominal force to be used to move the moving member 55. However, it is to be understood that the detent and recess could have more agressive shapes (e.g., a triangular shape) to increase the amount of force necessary to move the moving member 55**.

As shown in FIG. 6, the retaining cap 67 is longer in length than stem 65 and has an outer surface 79 adapted to be engaged by a person's thumb to move the blade holder between its retracted and extended positions. The retaining cap 67 is positioned relative to the stem 65 of the moving member 55 by a pair of fingers 81, 83 extending downwardly from the bottom surface of the cap (opposite outer surface 79) which engage a spring 85 which is held captive within a groove 87 provided in the base 63 of the moving member. Finger 81 comprises a stop 89*a* which engages the end of the protrusion 75 for stopping the retaining cap 67 when moving laterally towards the right (as viewed in FIG. 6) and finger 83 likewise comprises a stop 89*b* which engages end wall 91 of the stem for stopping the relative movement of the retaining .cap from the base and stem when the cap is moved laterally to the left (as viewed in FIG. 6). Finger 81 engages one side of the spring 85 while the other finger 83 engages the other side of the spring. The spring is provided for resisting the relative movement of the retaining cap from the base and stem. The arrangement being such that the retaining cap is capable of moving slightly when it is inadvertently moved by a force exerted thereon during use without moving the stem 65 (and the base 63) and the blade holder. The retaining cap is releasably attached to the stem by snapping the fingers 81, 83 within the opening 68. As shown in FIG. 7, a notch 84 provided in finger 81 allows the retaining cap to move relative to the stem without the finger engaging the edge of the opening 68.

The carton opener 11 is further provided with an end cap 93 for plugging the right-hand side opening of passageway 30 as shown in FIG. 1. End cap 93 comprises a portion 95 having generally the same transverse cross-sectional area as the sheath, and a resilient extended portion 97 extending from portion 95 and having a slightly smaller cross-sectional area than portion 95. The resilient extended portion 97 of the end cap is slidable within the passageway 30 to a position in which portion 95 abuts and is retained by the edge of the sheath. The resilient extended portion 97 has a notch 99 which is adapted to engage the edge of an enlarged opening 101 in the sheath (to the right of slot 53 and in communication therewith) for holding the end cap in place. The end cap 93 may be removed from the end of the sheath by pressing the resilient extended portion such that the notch disengages the edge of the opening 101 and then sliding the cap out of the sheath.

The moving member 55 is capable of being removed from the passageway in the sheath through opening 101 since the opening is slightly larger than that of the base 63. However, before the moving member 55 may be removed from the passageway, the end cap 93 must first be removed because the extended portion 97 of the end cap interferes with the base 63 of the moving member 55 when attempting to move the base so that the base (and opening 61 of the blade holder 13) is in registry with the opening 101.

In assembling the carton opener 11, the blade holder 13 is inserted in passageway 30 of the sheath 15. The opening 61 of the blade holder 13 is in registry with opening 101 of the sheath 15 such that the base 63 of moving member 55 is capable of being inserted within opening 61. After inserting the base of the moving member, the retaining cap 67 is attached to the stem 65 of the moving member by snapping the fingers 81, 83 within the opening 68. The moving member 55 may then be moved within slot 53 to the blade holder retracted position in which detent 59 engages recess 57*d*. At this point, end cap 93 may then be inserted in passageway to plug the end of the sheath 15 and thereby prevent the blade holder 13 from being removed from the sheath. The blade holder 13 may then moved to its third extended position or its most forwardly extended position, in which the detent 59 engages recess 57*c*. A blade 23 may easily be inserted in the holder within passageway 24 between layers 19 and 21 of the holder. The blade holder may then be moved to its other positions (e.g., first, second or retracted positions).

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A carton opener capable of cutting a carton comprises a blade holder of the type adapted to receive and hold a single edged razor blade, a sheath having a body portion including two side walls closely fitted about said blade holder, and a guide member extending generally forward of said body portion, said blade holder being adapted to slide within the sheath to anyone of a plurality of temporary locking positions including a blade retracted position in which the body portion of the sheath covers the blade, a first blade cutting position in which the blade held by the holder extends out forward of the body portion for cutting an edge of the carton with the aid of the guide member which guides the opener along the edge of the carton, a second blade cutting position in which the blade holder extends forwardly from the first cutting position such that the edge of the blade is positioned beyond the guide member, the guide member in the second blade cutting position being adapted to control the depth of the cut, and a blade extended position in which the blade holder extends forwardly of the second cutting position and forward of the body portion sufficiently to allow the blade to be removed and a new blade inserted into the blade holder, manually operable means for temporarily locking said blade holder in any one of said locking positions so as to prevent movement of the blade holder by application of force on the blade, said temporary locking means comprising a slot formed on one of said side walls longitudinally along the length of the sheath and a moving member attached to the blade holder extending from the blade holder through the slot, the moving member being in registry with the slot for moving the blade holder longitudinally with respect to the sheath, the slot having four recesses formed in one side of the slot, a first recess for positioning the blade holder in its first blade cutting position, a second recess for positioning the blade holder in its second blade cutting position, a third recess for positioning the blade holder in its blade extended position and a fourth recess for positioning the blade holder in its blade retracted position, the moving member comprising a detent spring-biased to the side of the slot having the recesses for releasably engaging the recesses when the detent is adjacent thereto, the recesses receiving the detent for positioning the blade holder relative to the sheath until a sufficient force is exerted on the moving member to move it against the bias of the detent such that the detent disengages a recess and engages the side of the slot, the moving member comprising a generally planar base adapted to slide within the sheath and being captured by the blade holder, a stem extending upwardly from the base through the slot for moving the blade holder with respect to the sheath, and a retaining cap removably attached to the stem opposite of the base, the retaining cap and the base having a greater width than the width of the slot and the stem having a lesser width than the width of the slot, the carton opener further comprising means for resisting movement of the moving member when nominal forces are exerted on the retaining cap of the moving member, the stem having a cavity formed therein which is accessible through an opening, said resisting means comprising two spaced apart fingers extending downwardly from the retaining cap through the opening in the cavity, the moving member having a spring which is engaged by the fingers for positioning the retaining cap relative to the stem, the arrangement being such that the retaining cap is capable of moving slightly without moving the base and the stem of the moving member when forces are inadvertently exerted on the moving member.

2. A carton opener as set forth in claim 1 wherein said guide member has first and second generally planar panels, the first panel extending generally forward and at an a obtuse lateral angle from the body portion, the second panel extending generally forward from the first panel, the plane of the second panel being generally perpendicular to the plane of the first panel, said guide member being configured for guiding the corner of the blade along an edge of a carton in a rearward direction of movement, said guide member further having forward and rearward edges.

3. A carton opener as set forth in claim 2 wherein said guide member has an upwardly flared margin extending from the rear edges of and at an angle to said first and second panels, said flared margin being adapted to prevent the snagging or catching of the rear edge of said guide member against the carton when said opener is cutting the edge of said carton.

* * * * *